US007942100B2

(12) United States Patent
Grove et al.

(10) Patent No.: US 7,942,100 B2
(45) Date of Patent: May 17, 2011

(54) BREAK DOWN DESK ASSEMBLY

(75) Inventors: James E. Grove, Marina Del Rey, CA (US); Thomas B. Hazzard, Ladera Ranch, CA (US); Burke Baker, Costa Mesa, CA (US)

(73) Assignee: True Sealing Concepts, LLC (MU)

( * ) Notice: Subject to any disclaimer, the term of this patent is extended or adjusted under 35 U.S.C. 154(b) by 608 days.

(21) Appl. No.: 11/825,871

(22) Filed: Jul. 11, 2007

(65) Prior Publication Data

US 2009/0013908 A1 Jan. 15, 2009

(51) Int. Cl.
*A47B 37/00* (2006.01)

(52) U.S. Cl. ..... 108/50.02; 108/153.1

(58) Field of Classification Search ..... 108/50.01, 108/50.02, 153.1, 180, 182, 186, 192, 193; 312/195, 196, 223.6, 223.2, 223.1
See application file for complete search history.

(56) References Cited

U.S. PATENT DOCUMENTS

| | | | | | |
|---|---|---|---|---|---|
| 3,521,579 | A | | 7/1970 | Stafford | |
| 5,207,162 | A | * | 5/1993 | Mismas | 108/65 |
| 5,231,562 | A | * | 7/1993 | Pierce et al. | 108/50.02 |
| 5,237,935 | A | * | 8/1993 | Newhouse et al. | 108/50.02 |
| 5,335,605 | A | * | 8/1994 | Drabczyk | 108/153.1 |
| 5,438,938 | A | * | 8/1995 | Meeker et al. | 108/91 |
| 5,640,912 | A | * | 6/1997 | Diffrient | 108/50.02 |
| 5,878,673 | A | * | 3/1999 | Kramer et al. | 108/50.02 |
| 5,901,513 | A | * | 5/1999 | Mollenkopf et al. | 108/50.02 |
| 5,934,203 | A | * | 8/1999 | Glass | 108/156 |
| 6,003,447 | A | * | 12/1999 | Cox et al. | 108/50.02 |
| 6,170,407 | B1 | * | 1/2001 | Hayward | 108/50.02 |
| 6,283,043 | B1 | * | 9/2001 | Stern et al. | 108/50.02 |
| 6,336,414 | B1 | * | 1/2002 | Stewart et al. | 108/50.02 |
| 6,450,107 | B1 | * | 9/2002 | Sanz Novales | 108/153.1 |
| 6,647,900 | B1 | * | 11/2003 | Kopish | 108/50.02 |
| 6,883,882 | B2 | * | 4/2005 | Lin | 312/265.5 |
| 6,895,868 | B1 | * | 5/2005 | Cronk et al. | 108/50.02 |
| 7,004,081 | B2 | * | 2/2006 | Chang | 108/50.01 |
| 7,066,097 | B2 | * | 6/2006 | Gayhart et al. | 108/50.02 |
| 7,343,864 | B2 | * | 3/2008 | Canin et al. | 108/50.02 |
| 2003/0089283 | A1 | * | 5/2003 | Okamoto et al. | 108/50.02 |
| 2005/0279257 | A1 | * | 12/2005 | Bettinger | 108/50.02 |

* cited by examiner

*Primary Examiner* — José V Chen
(74) *Attorney, Agent, or Firm* — Morland C. Fischer

(57) ABSTRACT

A break down desk is disclosed to facilitate an efficient storage disassembly and transport in compact shipping containers. The break down desk may be quickly and easily assembled and disassembled without the use of traditional tools and fasteners and with a minimal of assistance. A removable desktop is detachably connected to and across a pair of opposing side panels. The removable desktop includes a primary writing surface at the front, a file/paper stacking surface located behind the primary writing surface, and a pair of detachable side wings. A wire management channel, through which to receive an electrical wire from an electrical apparatus, runs around the desktop between the primary writing surface, the file/stacking surface, and the side wings. A cable routing trough, to guide the cable from an AC power strip received therewithin towards a source of power, is detachably connected between the pair of opposing side panels below the desktop. A cable access door is pivotally attached to the file/stacking surface of the desktop to be rotatable from a closed position, at which to prevent access to the cable routing trough through the desktop, to an open position, at which to permit access to the cable routing trough through the desktop.

12 Claims, 10 Drawing Sheets

BREAK DOWN DESK ASSEMBLY

BACKGROUND OF THE INVENTION

1. Field of the Invention

This invention relates to a break down desk, of the kind commonly used in a home or office, that is adapted to be quickly and easily assembled and disassembled without the use of tools to facilitate storage and transport in compact shipping containers. The desk top of the break down desk has an efficient wire and cable routing system to avoid unsightly and space-consuming wire and cable runs from electrical apparatus to a source of power.

2. Background Art

It is known for articles that are to be used in the home and office to be shipped to retailers and delivered to consumers unassembled in a shipping container. In the case of furniture, such disassembled and packaged household office articles are typically small and lightweight. Because of its large size, correspondingly heavy weight and complexity, it is not always practical to ship a desk to the consumer in a disassembled condition. Where a desk has been shipped unassembled, the consumer is often required to use special skill and have access to tools by which fasteners are inserted to connect the parts of the desk together. Accordingly, it would be desirable to have a break down desk that can be shipped to retailers and carried to the home of a consumer in a disassembled condition within a series of compact shipping containers so as to be efficiently transported and quickly and easily assembled without the use of special tools or skill.

With a varied assortment of readily available electrical apparatus (e.g., a lamp, telephone, pencil sharpener, personal and portable computers, etc.) to be laid and used upon the desktop, it is becoming increasingly difficult to manage the routing of wires and cables from the apparatus to a power source such as that available from an AC wall receptacle. The wire and cable runs may intersect, creating an unsightly appearance and an obtrusive environment which consumes valuable space on top of and down the sides of the desk. Computer cables may sometimes be too short to reach a wall receptacle and, therefore, require a cumbersome extension cord. Accordingly, it would also be desirable to have a desk with an efficient wire and cable routing management system by which wires and cables can be connected from desk mounted electrical apparatus to a suitable source of power in an organized and innocuous manner so as not to interfere with an efficient use of the desktop work surface.

SUMMARY OF THE INVENTION

A break down desk is disclosed that can be quickly and easily assembled and disassembled to facilitate an efficient storage and transport in a series of compact shipping containers. The desk includes a pair of hollow opposing side panels. A pair of stand-off risers project upwardly from each side panel. The desktop is detachably connected to and supported upon the stand-off risers by means of adjacent spring pin latch bodies. The spring pin latch bodies are affixed to the bottom of the removable desktop and carry spring-loaded locking pins that are slidable into receipt by spring pin cavities formed in the risers.

The top of the break down desk is removed from the stand-off risers as a unit when the locking pins of the spring pin actuator bodies are moved out of the spring pin cavities. The desktop has a primary writing surface located at the front of the desk and a file/paper stacking surface located at the rear of the desk behind the primary writing surface. A pair of side wings at opposite sides of the desktop are detachably connected to the primary writing surface and the file/paper stacking surface. In particular, a pair of tubular coupling members projecting from each one of the side wings are axially aligned for slidable receipt and locking engagement within corresponding pairs of complementary tubular coupling members that project from the primary writing surface and the file/paper stacking surface. A wire management channel runs around the desktop between the primary writing surface, the file/paper stacking surface and the side wings thereof. Wires from electrical apparatus (a lamp, pencil sharpener, personal computer, etc.) drop down through the wire management channel towards the floor to be connected to a nearby source of AC power.

A cable routing trough extends laterally between the opposing hollow side panels of the break down desk below the desktop. The cable routing trough is established between a cross beam and a cable guide that are disposed in opposite facing alignment with one another. Each side of the cross beam is detachably connected to the desk at a slotted bracket that is affixed inside a respective one of the side panels. The cable guide is detachably connected to the desk behind the cross beam by means of a pair of anti-swivel pins projecting from each side of the cable guide for slidable receipt by a groove formed inside a respective one of the side panels. The cable routing trough formed between the cross beam and the cable guide communicates with a cable routing hole that is formed at an inside wall of each of the hollow side panels. The cable from an AC power strip to be located within the cable routing trough will run through a cable routing hole and then drop down through one of the hollow side panels towards the floor to be connected to an AC wall receptacle.

Access to the cable routing trough and the power strip therewithin below the table top is achieved by way of a cable access door that is pivotally connected to the file/paper stacking surface by means of a 180 degree hinge. The cable access door is rotatable around its hinge from a closed position lying flush with the file/paper stacking surface to an open position folded back and over top of the file/paper stacking surface.

DESCRIPTION OF THE PREFERRED EMBODIMENT

Figure 1:
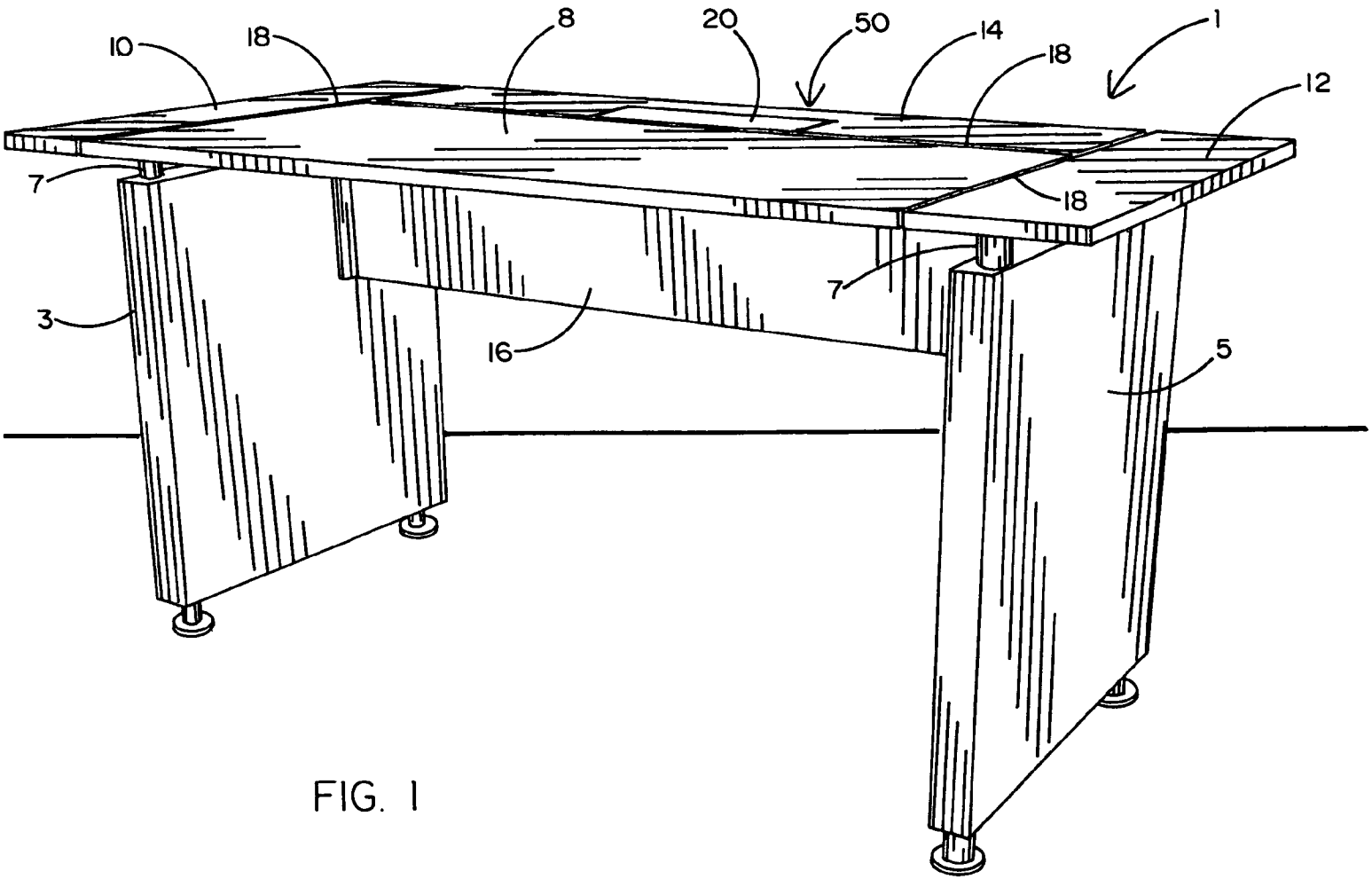
FIG. 1 shows the front of a break down desk according to a preferred embodiment of the present invention.
Figure 2:
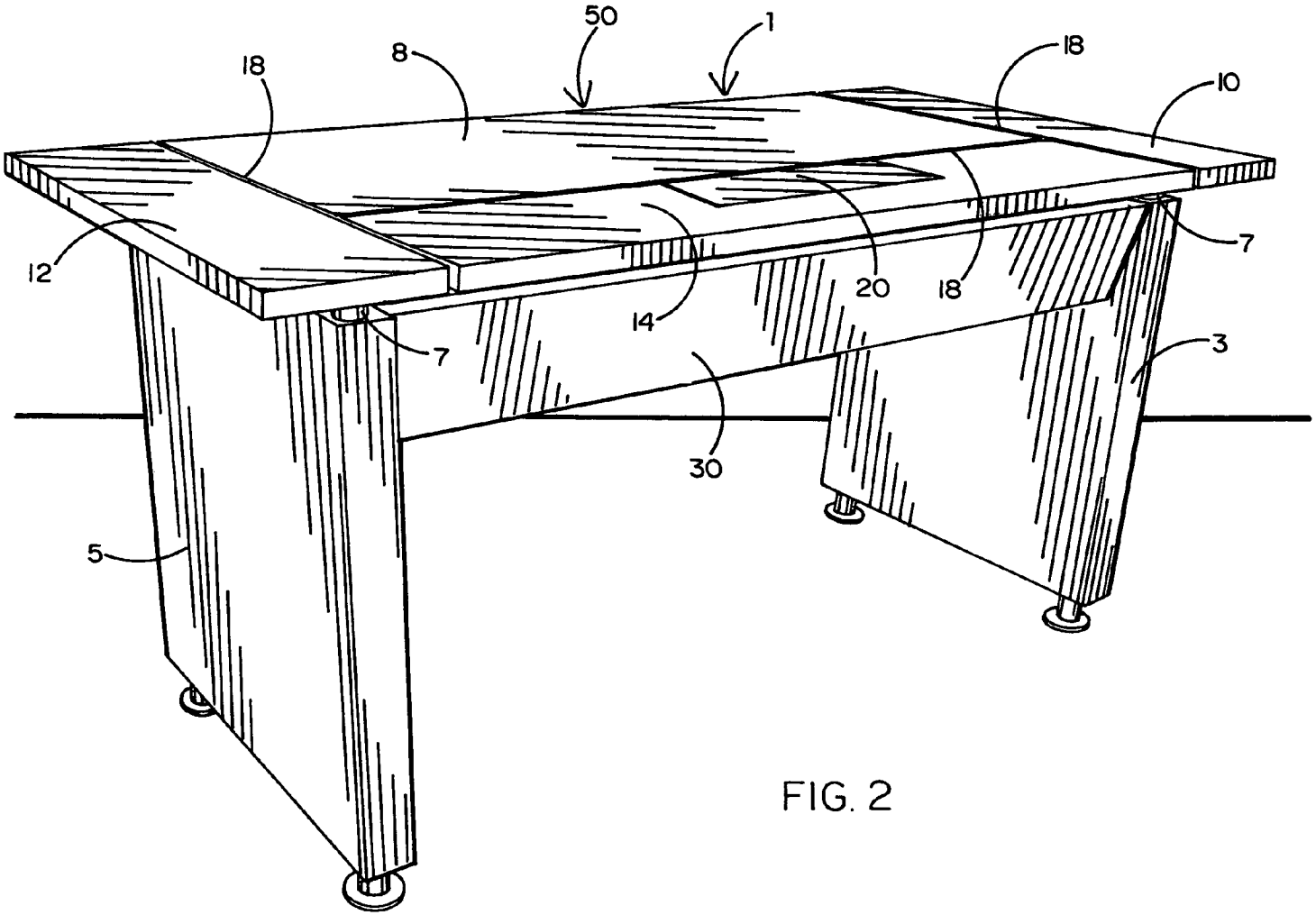
FIG. 2 shows the rear of the break down desk of FIG. 1.

The break down desk 1 for use in a home or office according to a preferred embodiment of the present invention is initially described while referring to FIGS. 1 and 2 of the drawings. The desk 1 has a pair of opposing hollow side panels 3 and 5 to support the top 50. The desktop 50 is held above the hollow side panels 3 and 5 by a set of (e.g., tubular steel) stand-off risers 7. The front of the desktop 50 includes a primary writing surface 8 that is located within reach and accessible to a user who is seated at the desk. A pair of side wings 10 and 12 of the desktop 50 are disposed at opposite sides of the primary writing surface 8. The rear of desktop 50 includes a file/paper stacking surface 14 that is located behind the primary writing surface 8 between side wings 10 and 12. A removable cross beam 16 extends laterally across the desk below the desktop 50 and between the opposing side panels 3 and 5.

As an important feature and advantage of the break down desk 1, the primary writing surface 8, side wings 10 and 12 and file/paper stacking surface 14 of the desktop 50 are all separated from one another by a gap so as to establish a wire management channel 18 running therebetween. As will be explained in greater detail hereinafter, the electrical wires which provide power to a variety of conventional electronic desk apparatus (e.g, a lamp, pencil sharpener, personal computer, and the like) that are placed on the desktop 50 can drop to an out-of-the-way location through the wire management channel 18 so as to be connected to a nearby source of AC electrical power. In this same regard, a cable access door 20 (best shown in FIG. 10) that is pivotally connected to the file/paper stacking surface 14 of the desktop 50 by means of a 180 degree (e.g., SOSS or blind) hinge (24 of FIG. 10) communicates with a cable routing trough (designated 22 in FIG. 2) to enable access to a standard AC power strip that is located within trough 22.

Figure 3:
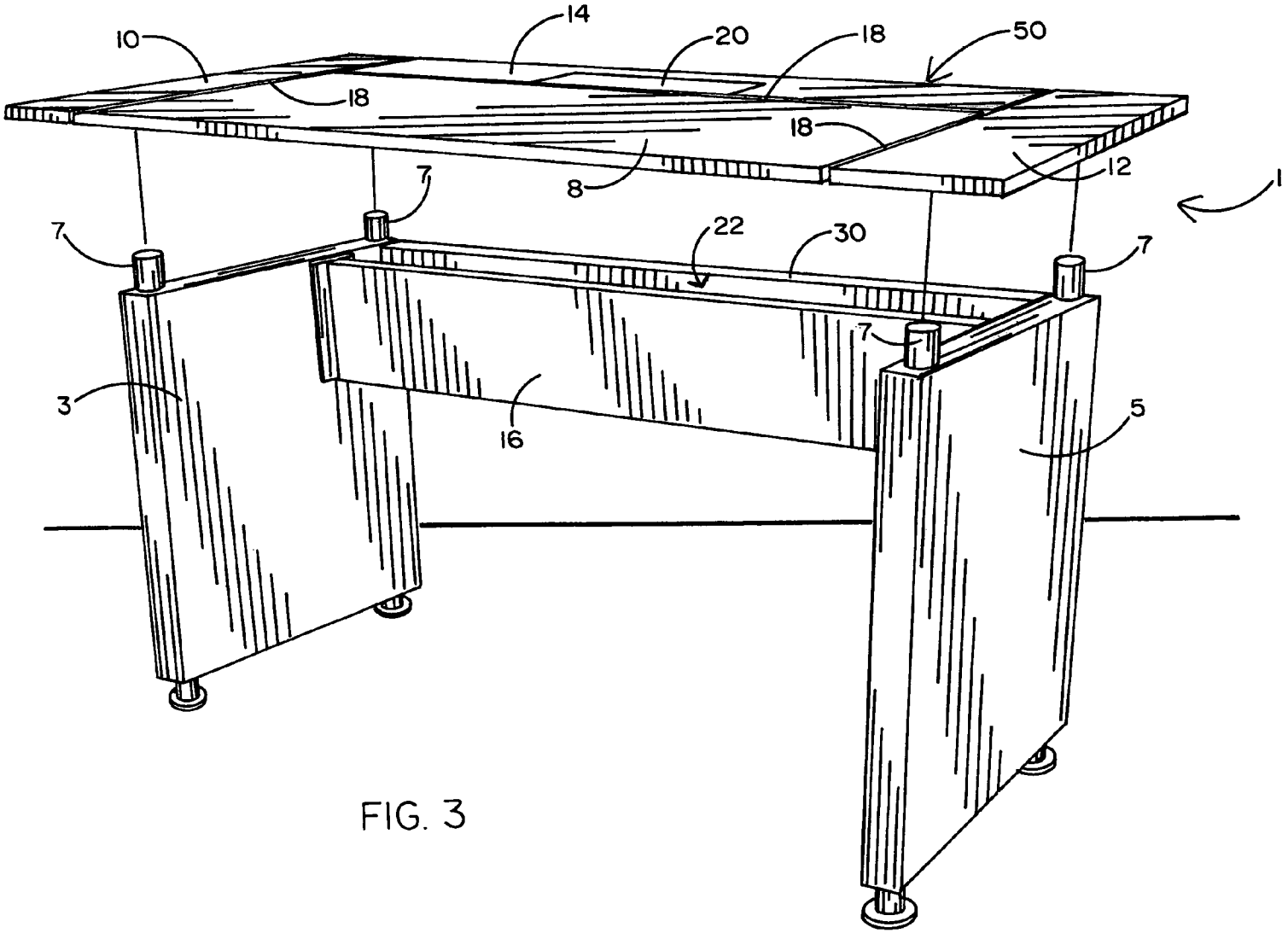
FIG. 3 shows the break down desk with a removable desktop detached as a unit to expose a laterally extending cable routing trough.
Figure 4:
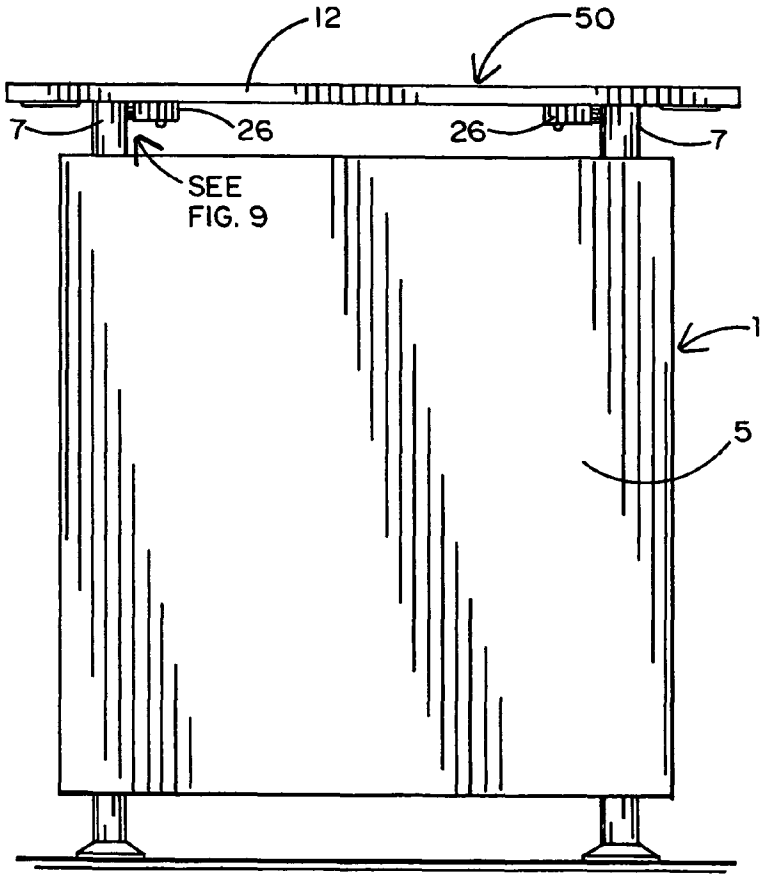
FIG. 4 is a side view of the break down desk with a cable access door of the desktop rotated to a closed position.

FIG. 3 of the drawings shows the top 50 of the break down desk 1 being lifted off (or seated upon) the stand-off risers 7 which stand upwardly from the opposing side panels 3 and 5. The details by which the desktop is detachably connected to the stand-off risers 7 so as to be held in place above side panels 3 and 5 and the cable routing trough 22 will be explained when referring to FIG. 9. Briefly, however, and referring to FIGS. 4 and 5 of the drawings, a set of spring pin latch bodies 26 are affixed to the desktop 50 below the side wings 10 and 12 thereof. In the assembled configuration, the spring pin latch bodies 26 are located adjacent respective ones of the upstanding stand-off risers 7. As is best shown in FIG. 10, each latch body 26 has a spring loaded locking pin (designated 76 in FIG. 10) that is adapted to slide into and out of locking engagement with its adjacent stand-off riser 7, whereby the desktop 50 will be reliably (and detachably) connected as a unit to the opposing side panels 3 and 5 of desk 1 by way of stand-off risers 7.

Figure 5:
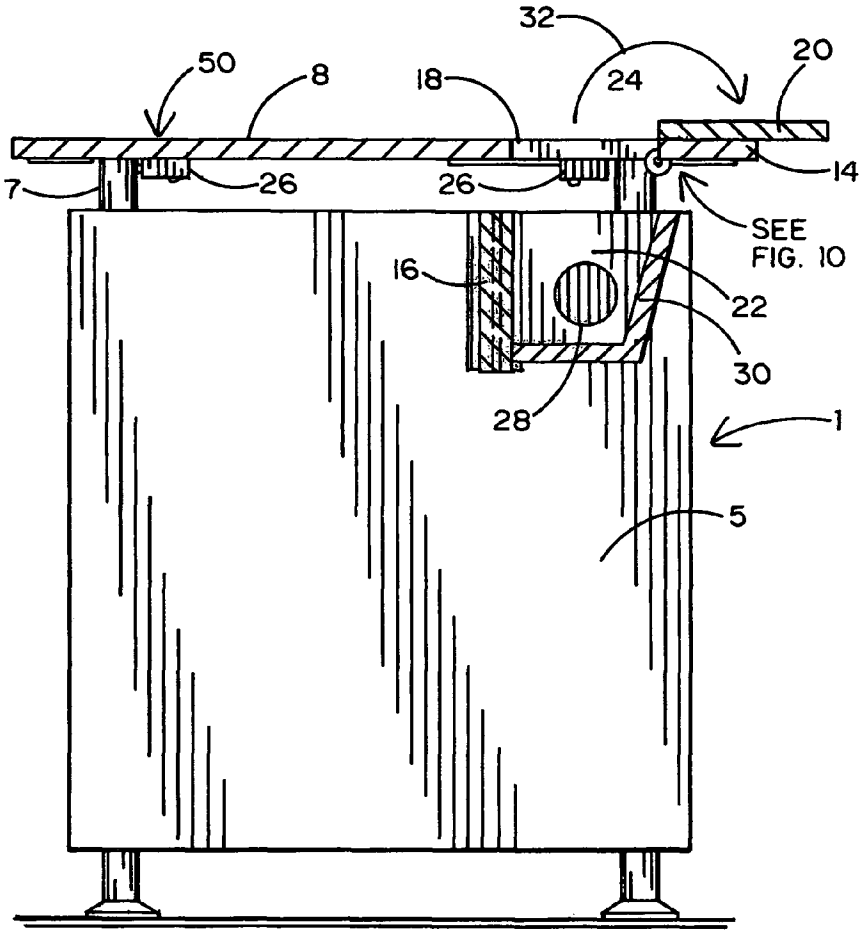
FIG. 5 is a side view of the break down desk with the cable access door of FIG. 4 rotated to an open position to permit access to the cable routing trough below the desktop.

FIGS. 3 and 5 show details of the cable routing trough 22 according to one preferred embodiment that is disposed below the top 50 of break down desk 1. As will also be explained when referring to FIG. 8, the cable routing trough extends laterally between the opposing side panels 3 and 5 and has a width that is sized to receive therein an AC power strip (not shown) which can be used to supply power to recharge a portable computer that is laid upon the primary writing surface 8 of the desktop 50. To this end, a cable (also not shown) that extends from the power strip will run through the trough 22 to one side of the desk for receipt through a cable routing hole 28 (best shown in FIGS. 5 and 8) that is formed at an inside wall of each of the opposing hollow side panels (e.g., 5). Once it is inserted through the cable routing hole 28, the power strip cable will simply drop downwardly through the hollow side panel 5 towards the floor to be grasped and connected to a nearby AC power receptacle.

The cable routing trough 22 is established by the interface of the laterally-extending cross beam 16 with a generally backwards L-shaped cable guide 30 (of FIG. 5). In the assembled relationship, the cross beam 16 forms the front of the cable routing trough 22 and the backwards L-shaped cable guide 30 forms the back and bottom of the trough. The top of the cable routing trough 22 is open so that the AC power strip may be place therewithin or removed therefrom. Access to the interior of the cable routing trough 22 through the desktop 50 is achieved by rotating the cable access door 20 in the direction of reference arrow 32 in FIGS. 5 and 10 by 180 degrees around hinge 24 from a closed position (best shown in FIG. 3) lying flush with the file/paper stacking surface 14 to an open position (best shown in FIGS. 5 and 10) lying back on the stacking surface 14.

Figure 6:
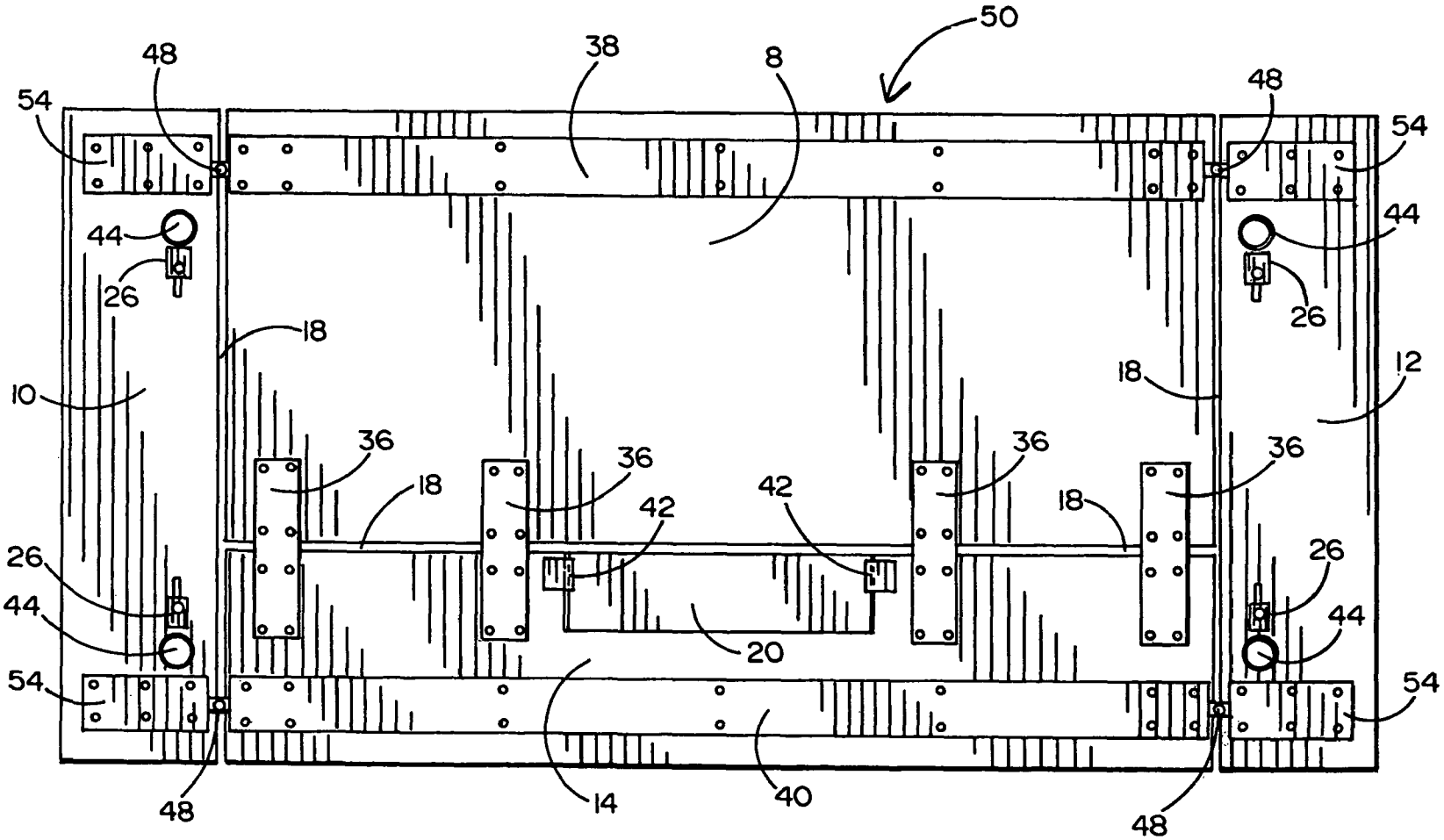
FIG. 6 shows the bottom of the removable desktop in a fully assembled configuration.
Figure 7:
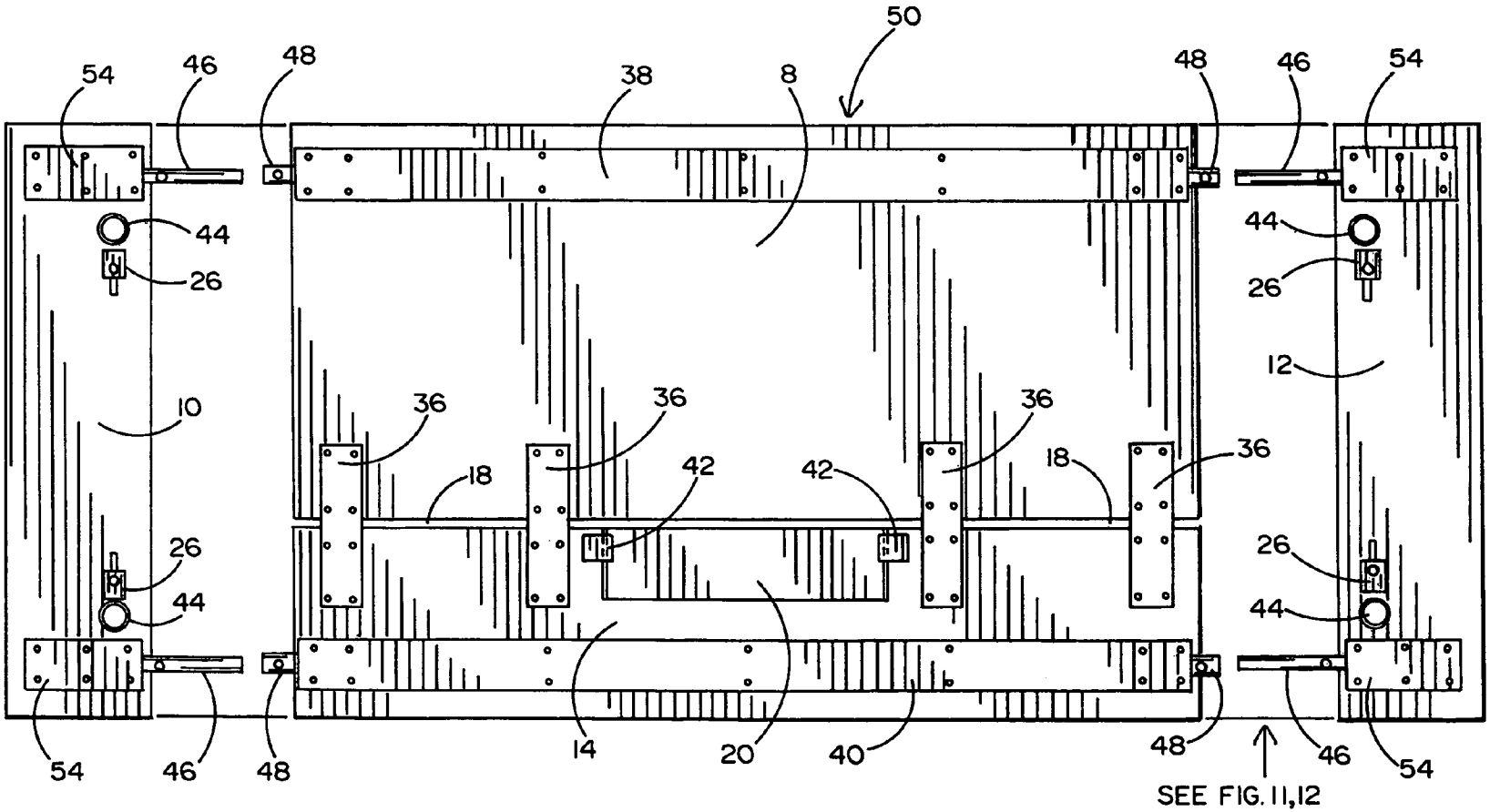
FIG. 7 shows the bottom of the removable desktop of FIG. 6 with detachable side wings separated therefrom.

FIGS. 6 and 7 of the drawings show the bottom of the top 50 of break down desk 1. FIG. 6 shows the desktop 50 in the fully assembled configuration ready for installation as a unit above the side panels 3 and 5 (of FIG. 3), and FIG. 7 shows the desktop 50 disassembled in the manner it will be packaged to facilitate a compact transport. In particular, the primary writing surface 8 at the front of desktop 50 and the file/paper stacking surface 14 at the rear of the desktop are connected together by means of (e.g., metallic) bridge plates 36 so as to be packaged side-by-side one another in a shipping container. A (e.g., metallic) support strap 38 and 40 runs across the bottom of each of the primary writing surface 8 and the file/paper stacking surface 14 to provide lateral support and structural reinforcement therefor. A pair of stops 42 (one of which being shown in FIG. 10) are affixed to the bottom of file/paper stacking surface 14 to engage opposite sides of the cable access door 20 when the door is rotated to its closed position above the cable routing trough (22 in FIG. 5) so as to lie flush with surface 14.

FIG. 6 shows the side wings 10 and 12 detachably connected to the adjacent primary writing surface 8 and the file/paper stacking surface 14 to complete the assembly of desktop 50 for connection to the opposing hollow side panels 3 and 5 of FIG. 3. To this end, each of the side wings 10 and 12 has a pair of riser recesses 44 formed therein and positioned to receive respective stand-off risers 7 of FIG. 3 so that desktop 50 can be attached to side panels 3 and 5. As was briefly described and as will be described in greater detail when referring to FIG. 9, spring pin latch bodies 26 are affixed to the bottom of each side wing 10 and 12 adjacent the riser recess 44. Spring loaded locking pins (designated 76 in FIG. 9) carried by latch bodies 26 are slidably and removably received by the stand-off riser 7 to prevent an inadvertent separation of the desktop 50 from the side panels 3 and 5 upon which the desktop is laid and supported during assembly of the desk 1.

When it is desirable to disassemble the break down desk 1 for storage and/or transport, the side wings 10 and 12 are detached from the adjacent primary writing surface 8 and the file/paper stacking surface 14. In this case, and as is best shown in FIG. 7, an outward pulling force separates the side wings 10 and 12 from the primary writing surface 8 and the file/paper stacking surface 14 so that the side wings can be packaged together to facilitate compact shipment. Accordingly, a fully assembled 60 inch wide desktop 50 can fit within a 48 inch wide shipping container when the desktop is disassembled in the manner that has just been described.

Figure 11:
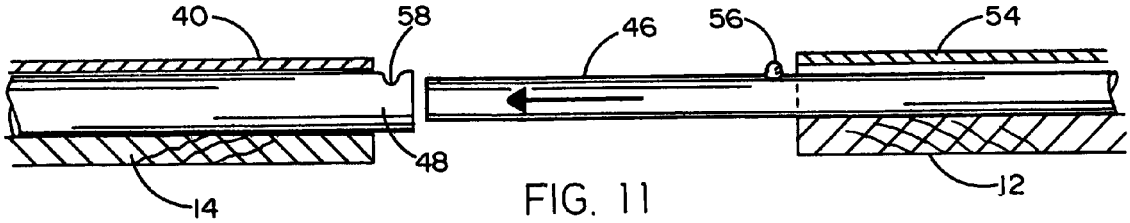
FIGS. 11 and 12 show details by which the detachable side wings of FIG. 7 are attached to and separated from the removable desktop.
Figure 12:
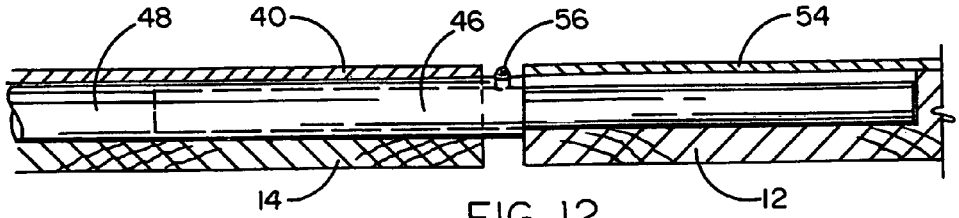

Referring concurrently in this regard to FIGS. 7, 11 and 12 of the drawings, a pair of tubular coupling members 46 are shown projecting from the inside of each side wing 10 and 12. Coupling members 46 are axially aligned to be slidably received by complementary opposing tubular coupling members 48 that project from opposite sides of the primary writing surface 8 and the file/paper stacking surface 14. The tubular coupling members 46 are covered over by cover plates 54 that are affixed to the bottom of the side wings 10 and 12, while the complementary tubular coupling member 48 are covered over by the support straps 38 and 40 that are affixed to the bottom of the primary writing surface 8 and the file/paper stacking surface 14, respectively.

A spring loaded pop-up pin 56 (best shown in FIG. 11) is carried by each coupling member 46. A pin cavity 58 is formed in each complementary coupling member 48 within which a coupling member 46 is to be slidably received. When it is desirable to assemble the desktop 50 of break down desk 1, the tubular coupling members 46 of side wings 10 and 12 are pushed inwardly of the opposing and axially aligned complementary tubular coupling members 48 of the adjacent primary writing surface 8 and file/paper stacking surface 14 (best shown in FIG. 12). The spring loaded pop-up pins 56 will first be pushed into their coupling members 46 and then pop up under spring action into receipt and capture by the pin cavities 58 of the complementary coupling members 48, whereby to prevent a detachment of the coupling members 46 and 48 and an inadvertent separation of the side wings 10 and 12. When it is desirable to disassemble the desktop 50 and separate the side wings 10 and 12 therefrom, a downward pushing force is applied to the spring loaded pins 56 to enable the coupling members 46 to be pulled outwardly and retracted from the complementary coupling members 48.

Figure 8:
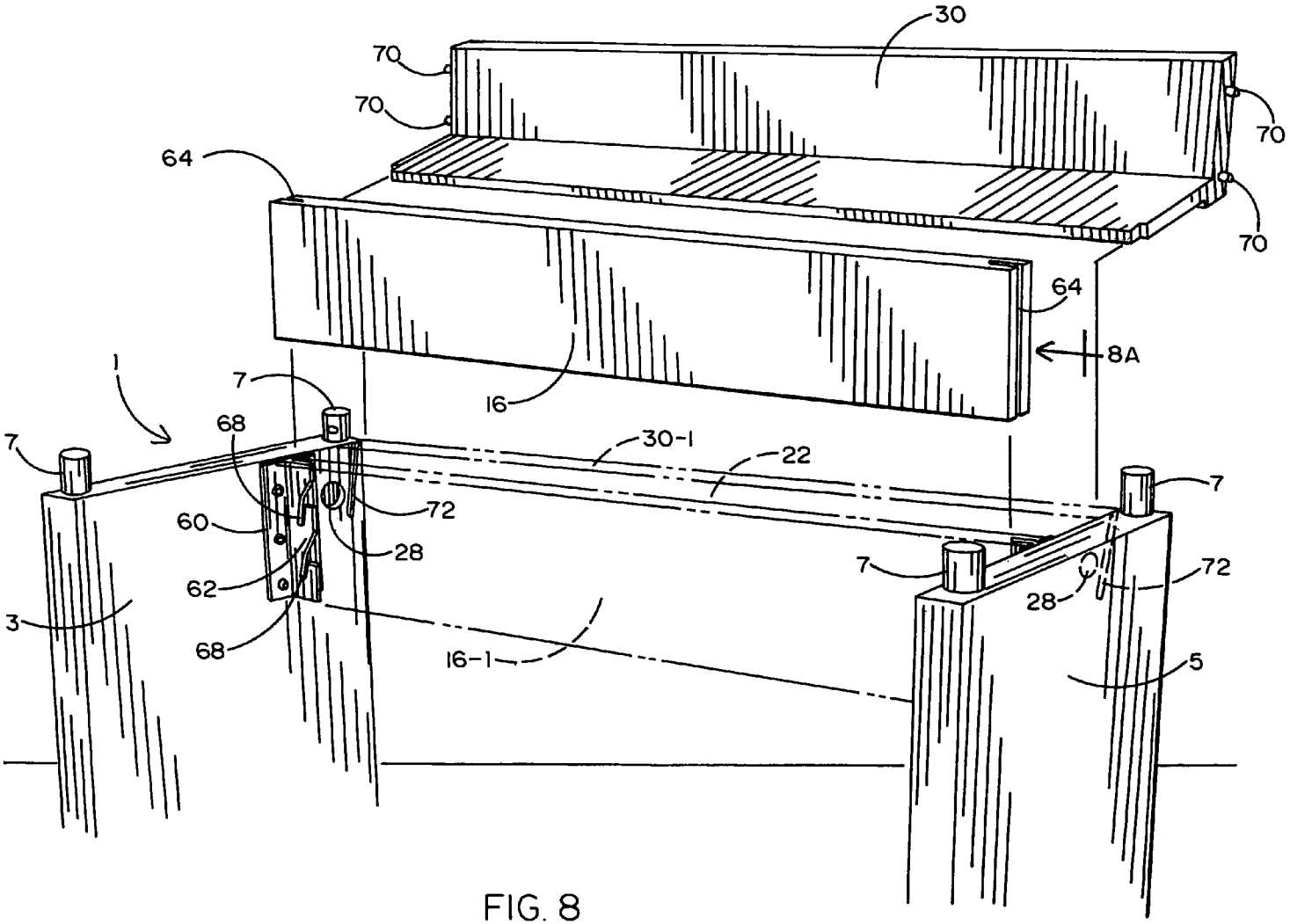
FIG. 8 shows the formation of the laterally extending cable routing trough according to a first embodiment by means of a cross beam and a cable guide detachably connected to opposing side panels of the break down desk below the removable desktop thereof.
Figure 8A:
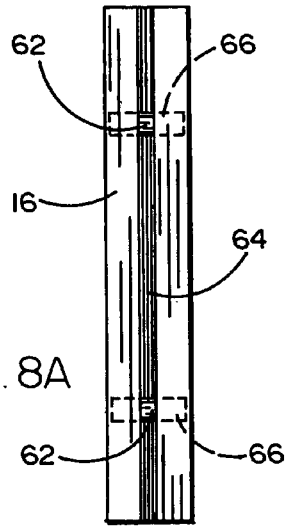
FIG. 8A shows a detail by which one side of the cross beam of FIG. 8 is detachably connected to one of the opposing side panels of the break down desk.

Turning now to FIGS. 8 and 8A of the drawings, details are provided for the detachable assembly of the cable routing trough 22 below the desktop 50 of break down desk 1. As previously disclosed, cable routing trough 22 is established by the interface of the cross beam 16 and the backwards L-shaped cable guide 30 which extend laterally between the opposing hollow side panels 3 and 5 of desk 1.

More particularly, a T-shaped flange 60 having a slotted bracket 62 is affixed to the inside wall of each side panel 3 and 5, such that the slotted brackets 62 are axially aligned with one another at opposite sides of the desk assembly. Each side of the cross beams 60 is provided with a gap 64. As is best shown in FIG. 8A, a pair of pins 66 extends across the gap p64 at each side of the cross beam 16. When it is desirable to attach the cross beam 16 to the opposing side panels 3 and 5 of desk 1, the cross beam 16 is pushed downwardly towards the T-shaped flanges 60, whereby each slotted bracket 62 is received by the gap 64 at one side of the cross beam. The pair of pins 66 (of FIG. 8A) which extend across the gap 64 will be received in respective slots 68 of the slotted bracket 62. In this manner, the cross beam 16 will be supported at the inside walls of opposing side panels 3 and 5 by the T-shaped flanges 62 affixed thereto.

A pair of anti-swivel pins 70 project outwardly from each opposite side of the backwards L-shaped cable guide 30. A groove 72 is formed at the inside wall of the each of the side panels 3 and 5. When it is desirable to attach the cable guide 30 to the opposing side panels 3 and 5 of desk 1, the cable guide 30 is pushed downwardly towards the side panels 3 and 5, whereby the pairs of anti-swivel pins 70 projecting from the opposite sides of cable guide 30 will be removably received by and ride through respective grooves 72 formed in the side panels. In this manner, the cable guide 30 will be supported at the side panels 3 and 5 by means of the receipt of the anti-swivel pins 70 within the opposing grooves 72. The pairs of pins 70 received by grooves 72 provide stability and prevent the cable guide 30 from swiveling relative to the cross beam 16 following installation.

In the assembled configuration, the laterally extending cross beam and cable guide (shown in phantom lines and designated 16-1 and 30-1 in FIG. 8) are detachably connected to the desk 1 in facing alignment with one another to establish the cable trough 22 therebetween. The cable trough 22 extends between the opposing hollow side panels 3 and 5 so as to communicate with the cable routing holes 28 also formed at the inside wall of each side panel. In this manner, and as was previously described, the cable from an AC power strip that is located in the cable routing trough 22 can travel along a cable routing path via the trough, be pushed through one of the cable routing holes 28, drop downwardly through one of the hollow side panels 3 and 5 that communicates with the hole 28, and be pulled outwardly from the bottom of the desk 1 for connection to an AC power receptacle.

Figure 9:
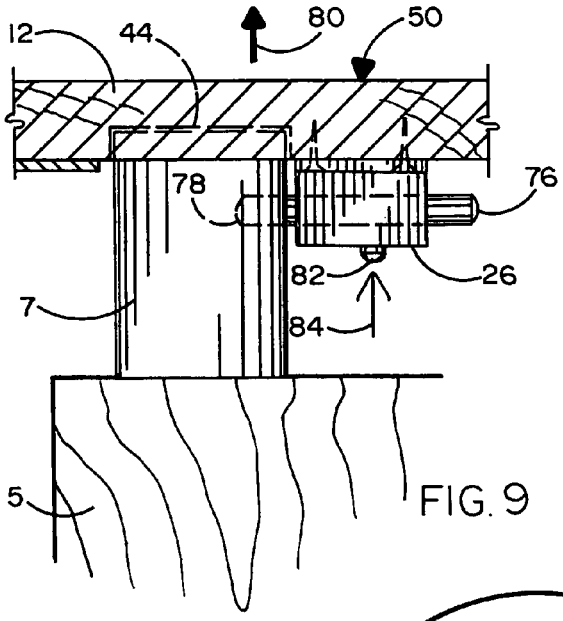
FIG. 9 shows a spring pin latch body having a spring loaded locking pin by means of which the removable desktop is detachably connected to a stand-off riser projecting from one of the opposing side panels of the break down desk.
Figure 10:
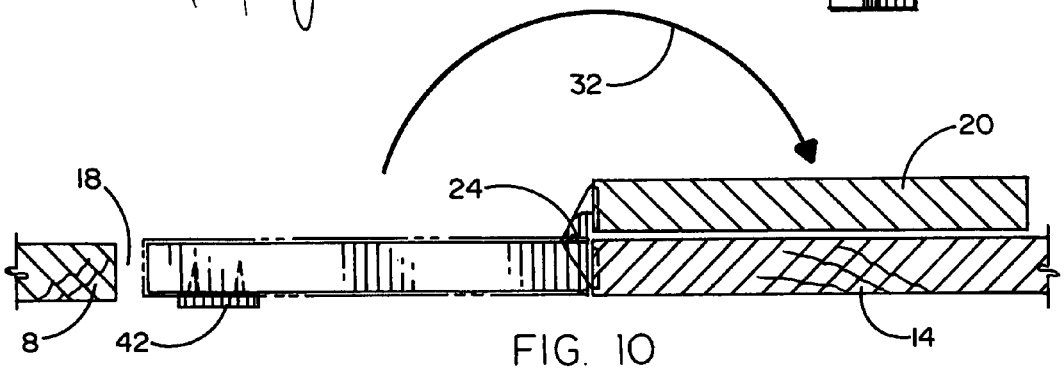
FIG. 10 shows the cable access door of FIG. 5 rotated to an open position over top a file/paper stacking surface of the removable desktop.

Referring to FIG. 9 of the drawings, details are now provided of the spring pin latch bodies 26 by which the side wings 10 and 12 of the desktop 50 are detachably connected to the stand-off risers 7 which stand upwardly from the opposing side panels 3 and 5 of the break down desk 1. Each of a pair of spring pin latch bodies 26 which are affixed to the bottom of one side wing (e.g., 12) carries a spring loaded locking pin 76. Each stand-off riser 7 has a spring pin cavity 78 that is aligned to receive therein the locking pin 76 carried by a spring pin latch body 26. That is, the locking pin 76 is slidable through its latch body 26 from an unlocked position removed from the spring pin cavity 78 in riser 7 to a locked position received inwardly of the cavity 78 in riser 7.

Once a stand-off riser 7 is located within a riser recess 44 that is formed in the bottom of side wing 12 to support the desktop 50 thereupon, an inward pushing force is applied to cause spring loaded locking pin 76 to slide in a first direction through its spring pin latch body 26 to the locked position and into receipt by the spring pin cavity 78 of an adjacent riser 7. Thus, the side wing 12 will be detachably connected to and supported by the upstanding stand-off riser 7. The receipt of locking pin 76 by the spring pin cavity 78 causes a spring (not shown) within latch body 26 to be compressed to store energy.

When it is desirable to lift a side wing 12 off the pair of stand-off risers 7 (in the direction of reference arrow 80) so as to remove the desktop 50 from the opposing side panels 3 and 5, a spring pin actuator button 82 is depressed inwardly of spring pin latch body 26 (in the direction of reference arrow 84) so as to cause the spring within latch body 26 to expand and release its stored energy. Accordingly, the locking pin 76 will be driven in an opposite direction through its latch body 26 to the unlocked position at which to be removed from the spring pin cavity 78 of riser 7. The side wing 12 will now be disconnected from the stand-off riser 7 to enable the disassembly of the break down desk 1.

FIGS. 13-16 of the drawings illustrate details of an alternate portable cable routing trough 90 that is disposed below the cable access door 20 at the top 50 of a break down desk 1' like that described while referring to FIGS. 1-12. Inasmuch as many of the features of the break down desk 1 of FIGS. 1-12 need not be changed to accommodate cable routing trough 90, identical reference numbers from the desk 1 are used to identify identical features of the desk 1' shown in FIGS. 13-16. Like the cable routing trough 22 earlier disclosed, the cable routing trough 90 may be easily carried and quickly assembled to the desk 1' between the hollow side panels 3 and 5 thereof to receive therewithin an AC power strip (not shown) from which power is available to recharge a portable computer that is laid upon the desktop 50. To this end, the cable routing trough 90 is aligned with a cable routing hole 28 that is formed through an inside wall of each hollow side panel 3 and 5 of the desk 1' to accommodate a run of cable from the power strip to be connected to a nearby AC power receptacle.

In the case of the cable routing trough 90 of FIGS. 13-16, the L-shaped cable guide (designated 30 and best shown in FIGS. 5-8) of the earlier described cable routing trough 22 is replaced by a pair of pivotal trough members 92 and 94. Pivotal trough members 92 and 94 cooperate with the cross beam 16 (also of FIGS. 5-8) that is connected to the opposing side panels 3 and 5 (best shown in FIG. 16) by means of respective T-shaped flanges 60 having slotted brackets 62 depending outwardly therefrom. A first of the pair of pivotal members 92 forms the bottom of cable routing trough 90, while the other pivotal member 94 forms the rear wall of trough 90. In the assembled configuration of FIG. 16, the existing cross beam 16 located closest to one seated at desk 1' forms the front wall of the trough 90.

The bottom and rear wall 92 and 94 of cable routing trough 90 are pivotally connected by means of a hinge 96. A pair of positioning holes 98 (best shown in FIG. 16) are formed below each end of the bottom trough member 92. A spring pin latch body 100 sits on top of each end of the bottom trough member 92, and a catch 102 sits on top of each end of the rear wall trough member 94.

As will soon be explained, the positioning holes 98 formed in the bottom trough member 92 are located so as to receive respective dowel pins 104, or the like (also best shown in FIG. 16), that project upwardly from an end brace 106 affixed to each side panel 3 and 5 of the desk 1'. A pin receiving hole 108 is formed in each side panel 3 and 5 to receive a respective spring biased locking pin 110 that is urged outwardly from each spring pin latch body 100 atop the bottom trough member 92. A spring biased roller lock 112 is mounted on each side panel 3 and 5 to receive and capture a respective catch 102 that is carried by the rear wall trough member 94 once trough member 94 is rotated relative to trough member 92 as will now be disclosed.

Figure 13:
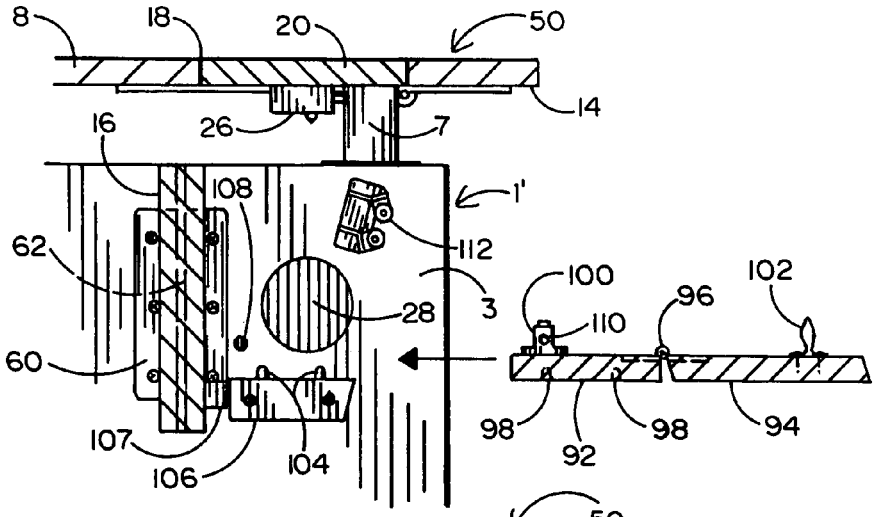
FIGS. 13-16 show the formation of the laterally extending cable routing trough according to an alternate embodiment by means of a cross beam and a pair of pivotally connected trough members detachably connected to opposing side panels below the removable desktop.
Figure 14:
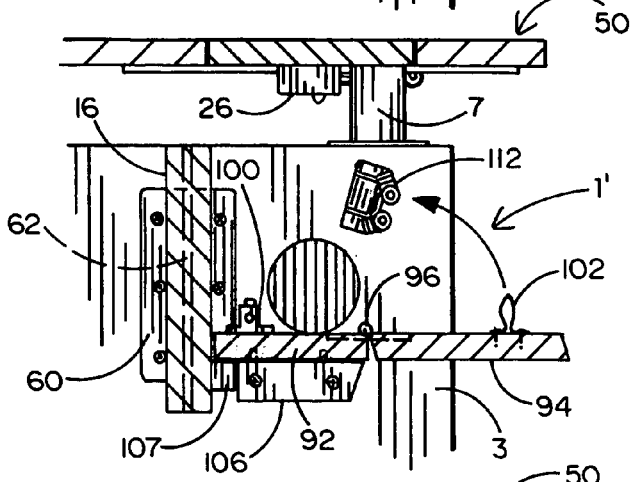

Initially, the pair of pivotal trough members 92 and 94 are carried to the desk 1' in an end-to-end alignment with one another in the manner shown in FIG. 13 to assemble the cable routing trough 90. As shown in FIG. 14, the bottom trough member 92 is seated upon the opposing end braces 106 that are affixed to side panels 3 and 5 so that the dowel pins 104 which project from braces 106 are received by the positioning holes 98 in the bottom of trough member 92. The receipt of the dowel pins 104 by positioning holes 98 prevents a linear displacement of the bottom trough member 92 relative to the cross beam 16 (i.e., the front wall of the cable routing trough 90).

At the same time, the bottom trough member 92 is also seated upon a set of (e.g., three) trough supports 107 (best shown in FIG. 16) that are attached to cross beam 16 and provide lateral support to trough member 92. The opposing end braces 106 also ensure that the ends of the bottom trough member 92 will be positioned so that the locking pins 110 of the spring latch bodies 100 will be aligned to move into respective ones of the pin receiving holes 108 that are formed in side panels 3 and 5 to prevent the bottom trough member 92 from being lifted off the trough supports 107 and moved away from cross beam 16.

Figure 15:
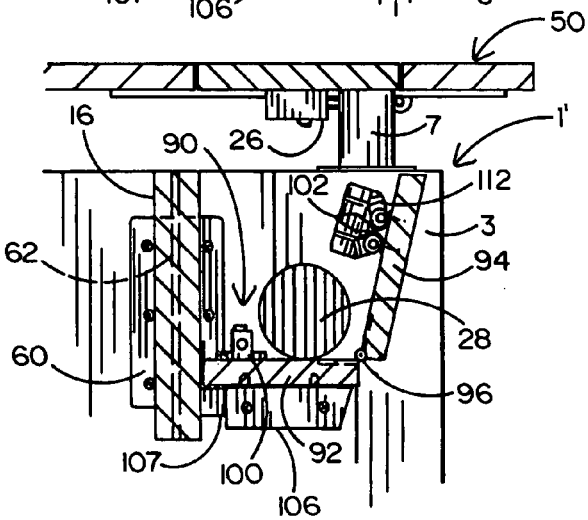
Figure 16:
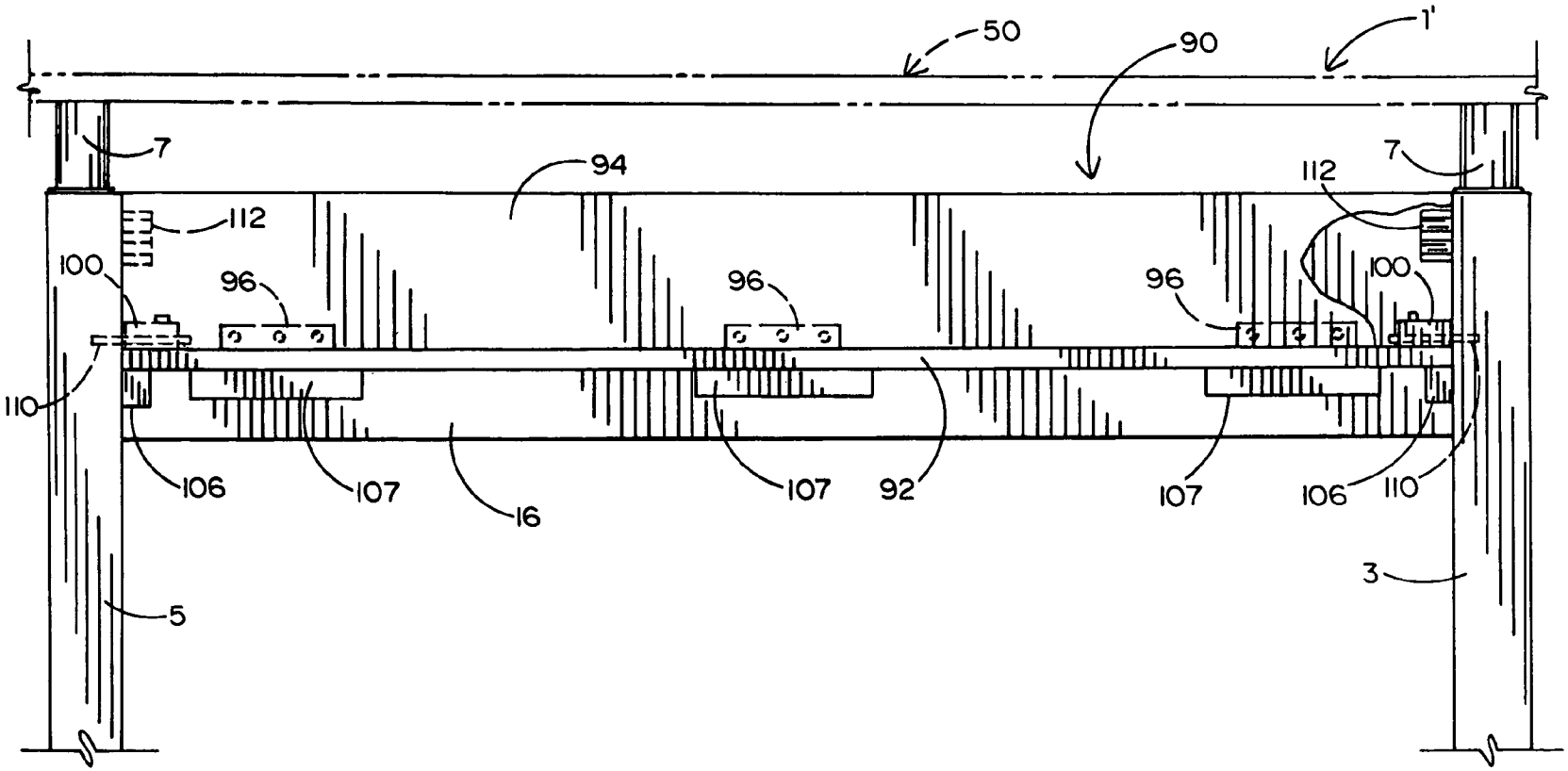

As shown in FIG. 15, the rear wall trough member 94 is now rotated upwardly around hinge 96 until the catches 102 that are carried at the ends of trough member 94 are moved into engagement with and captured by respective roller locks 112 mounted on side panels 3 and 5. With the catches 102 retained in interlocking engagement with the locks 112, the rear wall trough member 94 will be spaced from and lie opposite the front wall trough member (i.e., cross beam) 16 to be held in a generally upright, vertical position relative to the horizontal bottom trough member 92. Accordingly, it may be appreciated that only a short time, relatively little effort, and no tools are required to assemble the cable routing trough 90 of FIGS. 13-16 so as to be reliably attached to the break down desk 1' below desktop 50 and between side panels 3 and 5. In this same regard, should it be necessary to disassemble the desk 1' and the cable routing trough 90, a correspondingly short time and little effort will once again be required to first disengage and lower the rear wall trough member 94 and then carry trough members 92 and 94 away from the trough member (i.e., cross beam) 16.

By virtue of the foregoing features set forth while referring to FIGS. 1-16, a break down desk 1 and 1' will be available that may be quickly and easily assembled or disassembled by a user in his home or office. In its disassembled condition, the desk can be conveniently stored in a relatively small space and/or packaged in compact shipping containers to facilitate transport to its point of sale and to the home or office of the user. It may be appreciated that the desk is assembled by merely pushing the desk parts into interlocking and detachable engagement without the use of traditional hardware fasteners. Thus, no special skill, tools or fasteners are required to complete the desk assembly or disassembly.

The invention claimed is:

1. A desk capable of being assembled without the use of tools, said desk comprising:

a pair of desk sides spaced from one another;

a desktop detachably connected between said pair of desk sides by means of a plurality of locks carried by said desktop and moved into locking engagement with said pair of desk sides;

a cross beam located below said desktop and extending between said pair of desk sides; and a bracket affixed to each of said pair of desk sides and a gap formed in each of the first and opposite ends of said cross beam, said bracket having an upstanding bracket portion projecting away from a respective one of said pair of desk sides, said bracket portion being slidably and removably received within the gap formed in one of said first and opposite ends of said cross beam, whereby said cross beam is detachably connected to said pair of desk sides without the use of tools.

2. The desk recited in claim 1, wherein said desktop has a writing surface including first and opposite sides and a pair of side wings detachably connected to respective ones of said first and opposite sides to increase the size of said writing surface.

3. The desk recited in claim 1, further comprising at least one first coupling member located on each of said pair of side wings and at least one complementary coupling member located on each of the first and opposite sides of said writing surface in opposing alignment with said first coupling member, said first coupling member and said one complementary coupling member being slidably and removably mated to one another, whereby said pair of side wings are detachably connected to said respective ones of the first and opposite sides of said writing surface.

4. The desk recited in claim 1, wherein each of said pair of desk sides has at least one riser projecting therefrom by which to support said desktop, said plurality of locks carried by said desktop being moved into the said locking engagement with said pair of desk sides at respective ones of the said at least one riser projecting therefrom.

5. The desk recited in claim 4, wherein each of said plurality of said locks carried by said desktop includes a lock body and a locking pin slidable through said lock body and into said locking engagement with said at least one riser projecting from each of said pair of desk sides.

6. The desk recited in claim 1, also comprising a cable routing guide to receive an electrical cable to be routed to a source of electrical power, said cable routing guide detachably connected between said pair of desk sides below said desktop.

7. The desk recited in claim 6, wherein each desk side of said pair of desk sides has a hollow interior and a cable routing hole, said cable routing hole communicating with each of the hollow interior of said desk side and said cable routing guide to establish a cable routing path from said cable routing guide to the hollow interior of said desk side by way of said cable routing hole.

8. The desk recited in claim 6, wherein said desktop includes a cable access door located above said cable routing guide, said cable access door moving from a closed position to block access to said cable routing guide through said desktop to an open position to permit access to said cable routing guide through said desktop.

9. The desk recited in claim 1, wherein the upstanding bracket portion of said bracket has at least one slot formed therein, said desk further comprising a pin extending across the gap at each of said first and opposite ends of said cross beam, said pin being removably received within the slot of the upstanding bracket portion of said bracket by which said cross beam is detachably connected to said pair of desk sides without the use of tools.

10. The desk recited in claim 6, wherein said cable routing guide includes a wall extending between and detachably connected to said pair of desk sides so as to be spaced from and lie opposite said cross beam below said desktop, and a bottom extending between said cross beam and said wall.

11. The desk recited in claim 10, wherein the bottom of said cable routing guide is connected to and extends outwardly from said wall thereof towards said cross beam.

12. The desk recited in claim 10, wherein the wall of said cable routing guide has at least one pin projecting from each side thereof and each of said pair of desk sides has a groove formed therein, the pins projecting from the sides of said wall being slidably received by respective ones of the grooves formed in said desk sides, whereby said wall is detachably connected to said pair of desk sides.

* * * * *